US011532888B2

(12) United States Patent
Delaveaud et al.

(10) Patent No.: US 11,532,888 B2
(45) Date of Patent: Dec. 20, 2022

(54) FREQUENCY RECONFIGURABLE MONOPOLAR WIRE-PLATE ANTENNA

(71) Applicants: Commissariat à l'Energie Atomique et aux Energies Alternatives, Paris (FR); UNIVERSITE BREST BRETAGNE OCCIDENTALE, Brest (FR)

(72) Inventors: Christophe Delaveaud, Grenoble (FR); Lotfi Batel, Grenoble (FR); Jean-François Pintos, Grenoble (FR); Jean-Luc Mattei, Locmaria-Plouzane (FR); Alexis Chevalier, Landeda (FR); Vincent Laur, Milizac (FR)

(73) Assignees: Commissariat à l'Energie Atomique et aux Energies Alternatives, Paris (FR); UNIVERSITE BREST BRETAGNE OCCIDENTALE, Brest (FR)

( * ) Notice: Subject to any disclaimer, the term of this patent is extended or adjusted under 35 U.S.C. 154(b) by 28 days.

(21) Appl. No.: 17/197,507

(22) Filed: Mar. 10, 2021

(65) Prior Publication Data

US 2021/0288409 A1 Sep. 16, 2021

(30) Foreign Application Priority Data

Mar. 10, 2020 (FR) ..... 20 02363

(51) Int. Cl.

*H01Q 9/04* (2006.01)
*H01Q 9/40* (2006.01)
*H01Q 1/48* (2006.01)

(52) U.S. Cl.

CPC ..... *H01Q 9/40* (2013.01); *H01Q 1/48* (2013.01)

(58) Field of Classification Search

CPC ..... H01Q 9/0407; H01Q 9/40; H01Q 1/24–48
See application file for complete search history.

(56) References Cited

U.S. PATENT DOCUMENTS 6,750,825 B1 * 6/2004 Delaveaud ..... H01Q 5/357 343/749
7,129,899 B2 * 10/2006 Jecko ..... H01Q 9/0421 343/702

(Continued)

OTHER PUBLICATIONS

French Preliminary Search dated Nov. 18, 2020 in French Application 20 02363 filed Mar. 10, 2020, 12 pages (with English Translation of Categories of Cited Documents & Written Opnion).

(Continued)

*Primary Examiner* — Hasan Islam
(74) *Attorney, Agent, or Firm* — Oblon, McClelland, Maier & Neustadt, L.L.P.

(57) ABSTRACT

A monopole wire-plate antenna that is reconfigurable in a frequency range of operation, comprising:

a ground plane (1);
a capacitive roof (2);
a probe feed (3), which is electrically insulated from the ground plane (1), and which extends between the ground plane (1) and the capacitive roof (2) so as to electrically feed the capacitive roof (2);
at least one shorting wire (4), which is arranged to electrically connect the capacitive roof (2) to the ground plane (1), and which is coated in a magneto-dielectric material (5) having a complex magnetic permeability, which varies as a function of a static magnetic field applied to the magneto-dielectric material (5).

14 Claims, 6 Drawing Sheets

(56) References Cited

U.S. PATENT DOCUMENTS

| | | | | |
|---|---|---|---|---|
| 10,547,115 | B2 * | 1/2020 | Jouanlanne | H01Q 9/0421 |
| 10,854,977 | B2 * | 12/2020 | Chiu | H01Q 21/065 |
| 11,158,947 | B2 * | 10/2021 | Delaveaud | H01Q 9/36 |
| 11,196,162 | B2 * | 12/2021 | Jouanlanne | H01Q 9/0421 |
| 2006/0256017 | A1 | 11/2006 | Ishizaki | |

OTHER PUBLICATIONS

Batel et al., "Miniaturization strategy of compact antenna using magneto-dielectric material", 13$^{th}$ European Conference on Antennas and Propagation (EuCAP 2019), 2019, 5 pages.

Rongas et al., "Towards 600 MHz LTE Smartphones via Tunable Magnetodielectric Printed Inverted-F Antennas", 2017 International Workshop on Antenna Technology: Small Antennas, Innovative Structures, and Applications (iWAT), IEEE, 2017, 4 pages.

Xu et al., "A Novel Compact Microstrip Antenna Embedded with Magneto-Dielectric Ferrite Materials For 433 MHz Band Applications", 13$^{th}$ European Conference on Antennas and Propagation (EuCAP 2019), 2019, 4 pages.

Canneva et al., "Miniature Reconfigurable Antenna with Magneto Dielectric Substrate for DVB-H Band", Proceedings of the 5$^{th}$ European Conference on Antennas and Propagation (EUCAP), 2011, 4 pages.

* cited by examiner

FREQUENCY RECONFIGURABLE MONOPOLAR WIRE-PLATE ANTENNA

TECHNICAL FIELD

The invention relates to the technical field of monopole wire-plate antennas.

The invention is notably applicable to the Internet of Things (IoT), radiofrequency identification (RFID), communication in sensor networks, machine-to-machine (M2M) communication and communication in the fields of aeronautics and of space-technology.

PRIOR ART

A monopole wire-plate antenna known from the prior art, and notably from the document L. Batel et al., "*Design of a monopolar wire-plate antenna loaded with magneto-dielectric material*", EuCAP (*European Conference on Antennas and Propagation*), April 2018, comprises:

- a ground plane;
- a capacitive roof;
- a probe feed, which is electrically insulated from the ground plane, and which extends between the ground plane and the capacitive roof so as to electrically feed the capacitive roof;
- a shorting wire, which is arranged to electrically connect the capacitive roof to the ground plane, and which is coated in a magneto-dielectric material.

Such an antenna of the prior art, by virtue of the magneto-dielectric material coating the shorting wire, may have dimensions that are about 15% smaller in comparison with an architecture without magneto-dielectric material while providing a similar performance.

However, such a prior-art antenna is not always entirely satisfactory insofar as its small size generally leads to a narrow spectral band of operation, which is liable to not entirely cover the spectral band of a standard communication. A need may arise to widen its spectral band of operation via frequency agility. In other words, such a prior-art antenna is not reconfigurable in the sense that its frequency response cannot be modified during the operation thereof so as to tune it to a communication channel, after its manufacture.

Account of the Invention

The invention is targeted at completely or partially overcoming the abovementioned disadvantages. To this end, the subject of the invention is a monopole wire-plate antenna that is reconfigurable in a frequency range of operation, comprising:

- a ground plane;
- a capacitive roof;
- a probe feed, which is electrically insulated from the ground plane, and which extends between the ground plane and the capacitive roof so as to electrically feed the capacitive roof;
- at least one shorting wire, which is arranged to electrically connect the capacitive roof to the ground plane, and which is coated in a magneto-dielectric material having a complex magnetic permeability, which varies as a function of a static magnetic field applied to the magneto-dielectric material.

Definitions

By "ground plane", what is meant is an electrically conductive surface that is preferably made of metal and that forms an electrical ground plane so as to define a reference potential.

By "capacitive roof", what is meant is a generally planar, electrically conductive (preferably metal), surface that may for example be rectangular or circular in shape and that creates a capacitive effect with the ground plane. The term "planar" is to be understood to mean planar within the usual tolerances associated with the experimental conditions under which the capacitive roof is formed, and not to indicate perfect planarity in the geometric sense of the term.

By "probe feed", what is meant is any means for feeding the capacitive roof electrically. The probe feed may be a probe for exciting the antenna, which is conventionally connected to a central core of a coaxial guide and electrically connected to the capacitive roof. The probe feed is intended to be connected to a transmission line, i.e. to an element allowing the guided propagation of electromagnetic waves (e.g. waves in the radiofrequency range), the transmission line possibly being a coaxial-cable feed or another waveguide. The term "probe feed" may also cover a loop feed intended to be connected to a differential connection that makes it possible not to use a balun between the transmission line and the loop feed.

By "coated", what is meant is that the magneto-dielectric material covers (makes contact with) the entire free surface of the shorting wire.

By "magneto-dielectric material", what is meant is a material possessing, in the frequency range of operation, a relative permittivity ($\varepsilon_r$) that is strictly higher than 1, and a relative permeability ($\mu_r$) that is strictly higher than 1.

Thus, such an antenna according to the invention allows the resonant frequency to be moved, and therefore its operating point to be modified, by making the strength of a static magnetic field applied to the magneto-dielectric material vary. When the strength of the static magnetic field applied to the magneto-dielectric material is increased, the real part of the complex magnetic permeability decreases, and the resonant frequency of the antenna is moved to higher frequencies. Conversely, when the strength of the static magnetic field applied to the magneto-dielectric material is decreased, the real part of the complex magnetic permeability increases, and the resonant frequency of the antenna is moved to lower frequencies. Therefore, such a magneto-dielectric material permits the frequency response of the antenna to be reconfigured. It is possible to demonstrate that the resonant frequency varies as a function of the relative permeability ($\mu_r$) of the magneto-dielectric material according to a relationship of the type $$\frac{1}{\sqrt{\tan(\sqrt{\mu_r})}}.$$

The antenna according to the invention may comprise one or more of the following features.

According to one feature of the invention, the antenna comprises a DC current source configured to make an electrical current flow through the shorting wire, via the probe feed and the capacitive roof, so as to apply the static magnetic field to the magneto-dielectric material.

Thus, one obtained advantage is that the one or more shorting wires of a monopole wire-plate antenna are used to create a static magnetic field that is applied to the magneto-dielectric material (in an orthoradial direction, according to the Biot-Savart law), the DC current source being used to make a DC electrical current flow through the one or more shorting wires. Therefore, it is possible to control the resonant frequency of the antenna by controlling the magnitude of the current delivered by the DC current source.

According to one feature of the invention, the static magnetic field applied to the magneto-dielectric material has a strength lower than or equal to 400 $A \cdot m^{-1}$.

Thus, one obtained advantage is that DC current sources delivering currents of low magnitude (lower than 5 A) may be used to create the static magnetic field.

According to one feature of the invention, the complex magnetic permeability possesses a real part, and the magneto-dielectric material is such that the real part decreases, in the frequency range of operation, between 8% and 16% when the strength of the static magnetic field applied to the magneto-dielectric material passes from 0 to 400 $A \cdot m^{-1}$.

Thus, one obtained advantage is that the resonant frequency of the antenna is satisfactorily modulated by static magnetic fields of low strengths.

According to one feature of the invention, the complex magnetic permeability possesses a real part and an imaginary part, and the magneto-dielectric material is such that the ratio between the imaginary part and the real part is lower than 0.05 in an interval of the frequency range of operation, when the static magnetic field applied to the magneto-dielectric material has a strength lower than or equal to 400 $A \cdot m^{-1}$.

Thus, one obtained advantage is that magnetic losses in said interval (i.e. a frequency sub-range) belonging to the frequency range of operation are very low.

According to one feature of the invention, the magneto-dielectric material has a complex dielectric permittivity that remains constant as a function of the static magnetic field applied to the magneto-dielectric material.

Thus, one obtained advantage is that the complex dielectric permittivity remains constant in the frequency range of operation.

According to one feature of the invention, the antenna comprises a set of shorting wires, which are arranged in parallel around the probe feed so that each shorting wire electrically connects the capacitive roof to the ground plane, each shorting wire being coated in a magneto-dielectric material having a complex magnetic permeability that varies as a function of a static magnetic field applied to the magneto-dielectric material.

Thus, one advantage obtained by placing a set of shorting wires, each wire of which is coated with a magneto-dielectric material, in parallel is that it allows the interaction between the antenna and the magneto-dielectric material to be improved, and therefore the antenna loaded with the magneto-dielectric material to be miniaturized more effectively.

According to one feature of the invention, the probe feed is arranged at the center of the ground plane, and the set of shorting wires comprises at least one pair of shorting wires that is arranged around the probe feed in such a way as to exhibit central symmetry.

Thus, one obtained advantage is that the radiation pattern of the antenna is symmetrical and cross-polarization decreased.

According to one feature of the invention, the probe feed is coated in a magneto-dielectric material having a complex magnetic permeability that varies as a function of a static magnetic field applied to the magneto-dielectric material.

Thus, one obtained advantage is that the amount of magneto-dielectric material in the antenna and hence the effectiveness with which the antenna is loaded by the magneto-dielectric material is increased, with a view to decreasing its dimensions.

According to one feature of the invention, the antenna comprises a magneto-dielectric layer extending between the ground plane and the capacitive roof so as to coat the one or more shorting wires and the probe feed, the magneto-dielectric layer being made of a magneto-dielectric material having a complex magnetic permeability that varies as a function of a static magnetic field applied to the magneto-dielectric material.

Thus, one obtained advantage is that the antenna is simple to manufacture.

According to one feature of the invention, the capacitive roof and the ground plane delineate a cylindrical volume, and the magneto-dielectric layer extends into all or part of the cylindrical volume.

Definition

The term "cylindrical" designates the shape of a cylinder the surface of which is generated by a family of straight lines of same direction (generatrices). By way of examples, the right section of the cylinder (i.e. the intersection of the surface with a plane perpendicular to the direction of the generatrices) may be circular or quadrangular (e.g. rectangular).

According to one feature of the invention, the magneto-dielectric material is chosen such that the relationship $\mu_r > \varepsilon_r > 1$ is respected in the frequency range of operation, where:

- $\mu_r$ is the relative permeability of the magneto-dielectric material;
- $\varepsilon_r$ is the relative permittivity of the magneto-dielectric material.

Thus, one advantage obtained via such a magneto-dielectric material is that it contributes to the miniaturization of the antenna by decreasing the wavelength ($\lambda_g$) guided in the material according to the following formula:

$$\lambda_g = \frac{\lambda}{\sqrt{\varepsilon_r \mu_r}}$$

where $\lambda$ is the wavelength of operation of the antenna.

To favor miniaturization of the antenna, it is therefore sought to maximize the product of $\varepsilon_r$ and $\mu_r$.

More precisely, the fact that $\mu_r > \varepsilon_r > 1$ allows a high $\mu_r$ to be favored over a high $\varepsilon_r$, this being desirable as an overly high $\varepsilon_r$ generally results in the electromagnetic field becoming highly concentrated in the antenna, potentially causing impedance-matching problems, and thus a decrease in the transfer of electromagnetic (e.g. radiofrequency) power to free space. Furthermore, the monopole wire-plate antenna interacts effectively with the magnetic properties of the magneto-dielectric material via the one or more shorting wires, this endowing it with a specific near-field magnetic behavior.

According to one feature of the invention, the magneto-dielectric material is chosen from $Ni_{1-x}Zn_{1-y}Co_{1-z}Fe_{2-\delta}O_4$, with $0.5<x<0.8$; $0.2<y<0.8$; $0<z<0.2$; and $\delta<0.5$.

Thus, such magneto-dielectric materials possess advantageous properties:

(i) the relationship $\mu_r>\varepsilon_r>1$ is respected, (ii) high sensitivity of the complex magnetic permeability, i.e. sensitive to a variation in a static magnetic field of low strength (lower than 400 $A\cdot m^{-1}$), (iii) $Fe_{2-\delta}$ allows dielectric losses to be limited, (iv) $Ni_{1-x}$ allows electromagnetic losses in the frequency range of operation (in particular [30 MHz-250 MHz]) to be limited, (v) $Co_{1-z}$ allows domain walls to be trapped within the material.

According to one feature of the invention, the capacitive roof and the ground plane each have a maximum characteristic dimension such that the antenna is contained in a sphere with an electric radius smaller than or equal to $\lambda/2\pi$, where $\lambda$ is the wavelength of operation of the antenna.

Thus, one obtained advantage is that a miniature antenna is obtained. By "miniature", what is meant is that the antenna is contained in a sphere (called the Wheeler sphere) with an electric radius smaller than or equal to $\lambda/2\pi$. For example, in the case of a circular capacitive roof, the radius of the Wheeler sphere is the hypotenuse of a right-angled triangle the right angle of which is formed by a radius of the capacitive roof and by the height of the antenna (Euclidean distance between the ground plane and the capacitive roof).

According to one feature of the invention, the frequency range of operation is comprised between 30 MHz and 250 MHz.

Thus, one advantage of the VHF band (VHF being the acronym of very high frequency) is that it is favorable to mobile and fixed links employing low powers, terrestrial, maritime or aeronautic links for example.

BRIEF DESCRIPTION OF THE DRAWINGS

Other features and advantages will become apparent from the detailed description of various embodiments of the invention, the description being accompanied by examples and references to the appended drawings.

Figure 1:
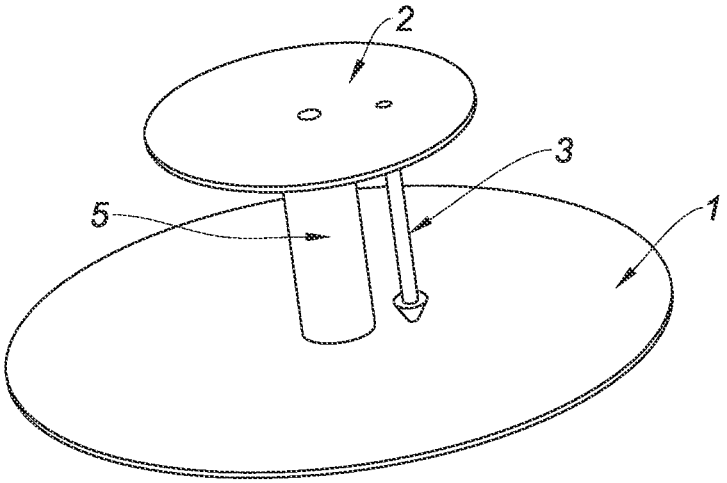
FIG. 1 is a schematic perspective view of a monopole wire-plate antenna according to the invention, illustrating a single shorting wire coated in a magneto-dielectric material.

It should be noted that, for the sake of legibility and ease of understanding, the drawings described above are schematic, and not necessarily to scale.

DETAILED DISCLOSURE OF THE EMBODIMENTS

For the sake of simplicity, elements that are identical or that perform the same function in the various embodiments have been designated by the same references.

One subject of the invention is a monopole wire-plate antenna that is reconfigurable in a frequency range of operation, comprising:

- a ground plane 1;
- a capacitive roof 2;
- a probe feed 3, which is electrically insulated from the ground plane 1, and which extends between the ground plane 1 and the capacitive roof 2 so as to electrically feed the capacitive roof 2;
- at least one shorting wire 4, which is arranged to electrically connect the capacitive roof 2 to the ground plane 1, and which is coated in a magneto-dielectric material 5 having a complex magnetic permeability, which varies as a function of a static magnetic field applied to the magneto-dielectric material 5.

Ground Plane

Figure 2:
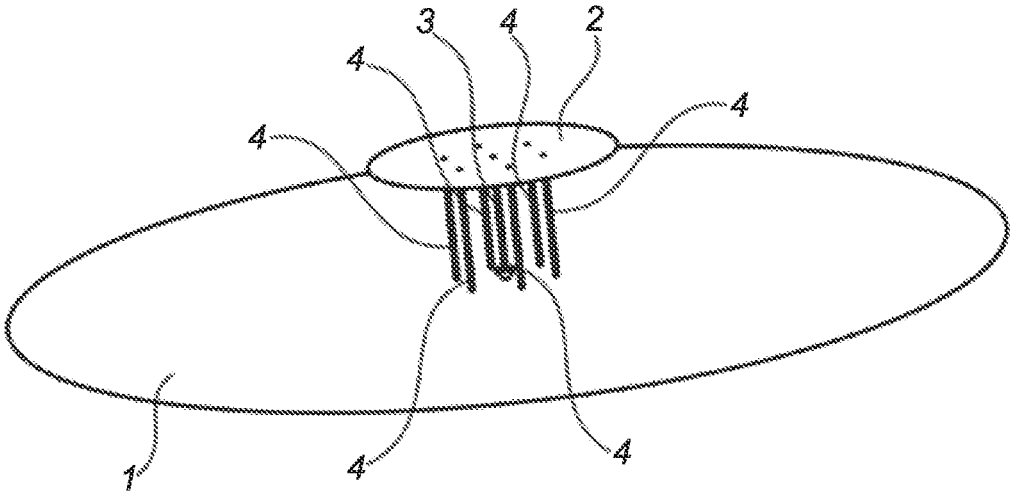
Fig. 2 Background Art
FIG. 2 is a schematic perspective view of a prior-art monopole wire-plate antenna, illustrating a set of shorting wires that are arranged in parallel around the probe feed so that each shorting wire electrically connects the capacitive roof to the ground plane, the shorting wires not being coated with a magneto-dielectric material.
Figure 3:
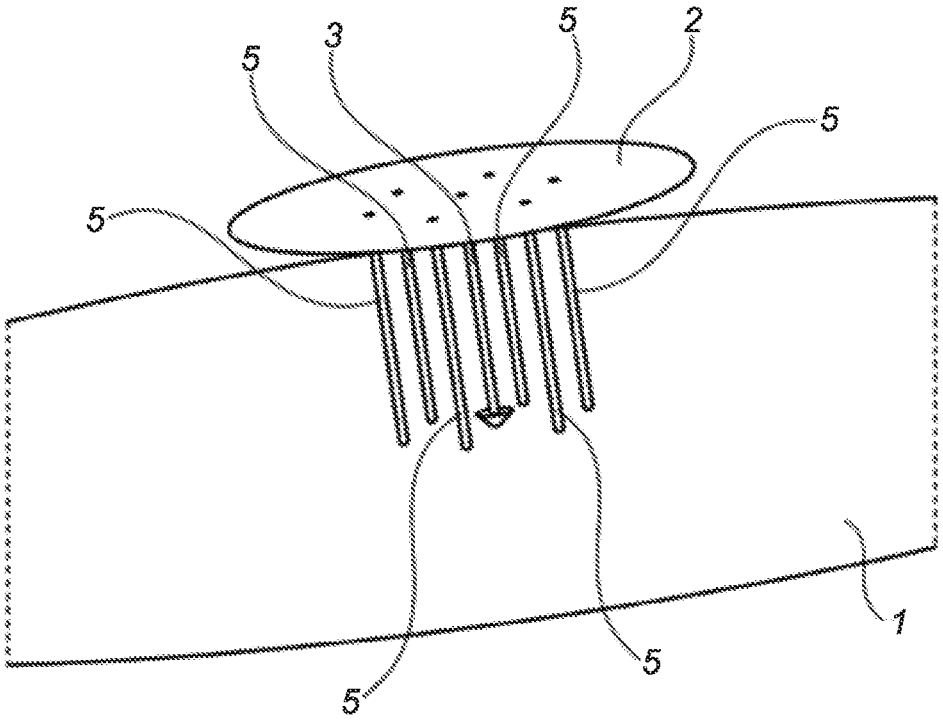
Fig. 3 Background Art
FIG. 3 is a schematic view, analogous to that of FIG. 2 but at larger scale, of a monopole wire-plate antenna according to the invention, in which the shorting wires are coated with a magneto-dielectric material.

The ground plane 1 may be formed from a metal material, such as copper. The ground plane 1 may be circular in shape, as illustrated in FIGS. 1 to 3. However, other shapes are envisionable for the ground plane 1, such as a rectangular shape (illustrated in FIGS. 4 to 6) or square shape.

The ground plane 1 may be formed on a dielectric substrate (not illustrated). An aperture is produced in the ground plane 1 (and where appropriate in the dielectric substrate) so as to allow the probe feed 3 to pass through.

It is possible for the ground plane 1 to be equipped with components, for example a direct-current (DC) circuit, a radiofrequency (RF) circuit or a battery, without adversely affecting the operation of the antenna.

Capacitive Roof

The capacitive roof 2 comprises an electrically conductive, and preferably metal, planar surface. The capacitive roof 2 advantageously lies parallel to the ground plane 1. The term "parallel" is understood to mean parallel within the usual tolerances associated with the experimental conditions under which the elements of the antenna are formed, and not to indicate perfect parallelarity in the mathematical (geometric) sense of the term. However, the capacitive roof 2 may have an inclination with respect to the ground plane 1, provided that a capacitive effect is still created with the ground plane 1. The angle of inclination made between the capacitive roof 2 and the ground plane 1 is preferably smaller than or equal to 30°.

The capacitive roof 2 thus creates a capacitive effect with the ground plane 1, allowing the resonant frequency of the antenna to be lowered, or the length of the monopole (i.e. the probe feed 3) to be decreased for a given resonant frequency. The capacitive roof 2 is preferably circular in shape, for example with a radius of about $\lambda/11$, where $\lambda$ is the wavelength of operation of the antenna. By way of non-limiting example, in the very-high-frequency (VHF) band, at 135 MHz, the radius of the capacitive roof 2 is about 200 mm.

However, other shapes are envisionable for the capacitive roof 2, such as a square, rectangular, elliptical or star shape.

The frequency range of operation of the antenna is advantageously comprised between 30 MHz and 250 MHz.

Probe Feed

The probe feed 3 does not make contact with the ground plane 1 so as to be electrically insulated from the ground plane 1. By way of non-limiting example, the probe feed 3 may be joined to the ground plane 1 using a spacer (not illustrated) that is not electrically conductive.

The probe feed 3 advantageously extends perpendicular to the ground plane 1, and therefore perpendicular to the capacitive roof 2, in order to prevent the radiation pattern of the antenna from being disrupted by the ground plane 1. The probe feed 3 may be connected to a metal central core 30 of a coaxial waveguide. The probe feed 3 extends between the ground plane 1 and the capacitive roof 2, for example over a height of about $\lambda/11$, where $\lambda$ is the wavelength of operation of the antenna. By way of non-limiting example, in the very-high-frequency (VHF) band, at 135 MHz, the height of the probe feed 3 (between the ground plane 1 and the capacitive roof 2) is about 200 mm.

Figure 4:
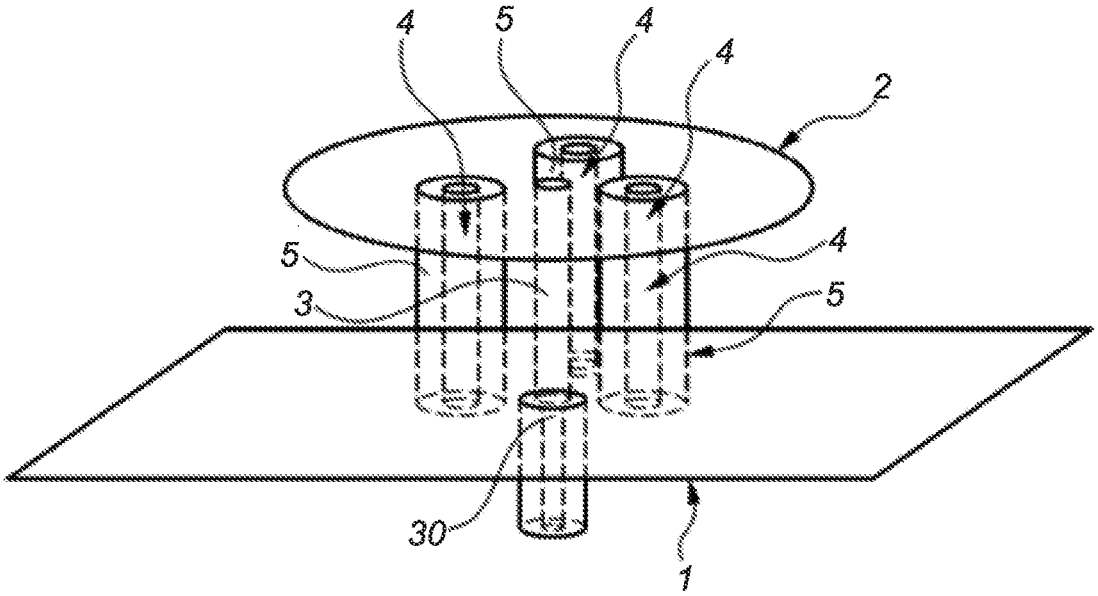
FIG. 4 is a schematic perspective view of an antenna according to the invention, illustrating a first embodiment of the coating (individual coating of the shorting wires) with the magneto-dielectric material.
Figure 5:
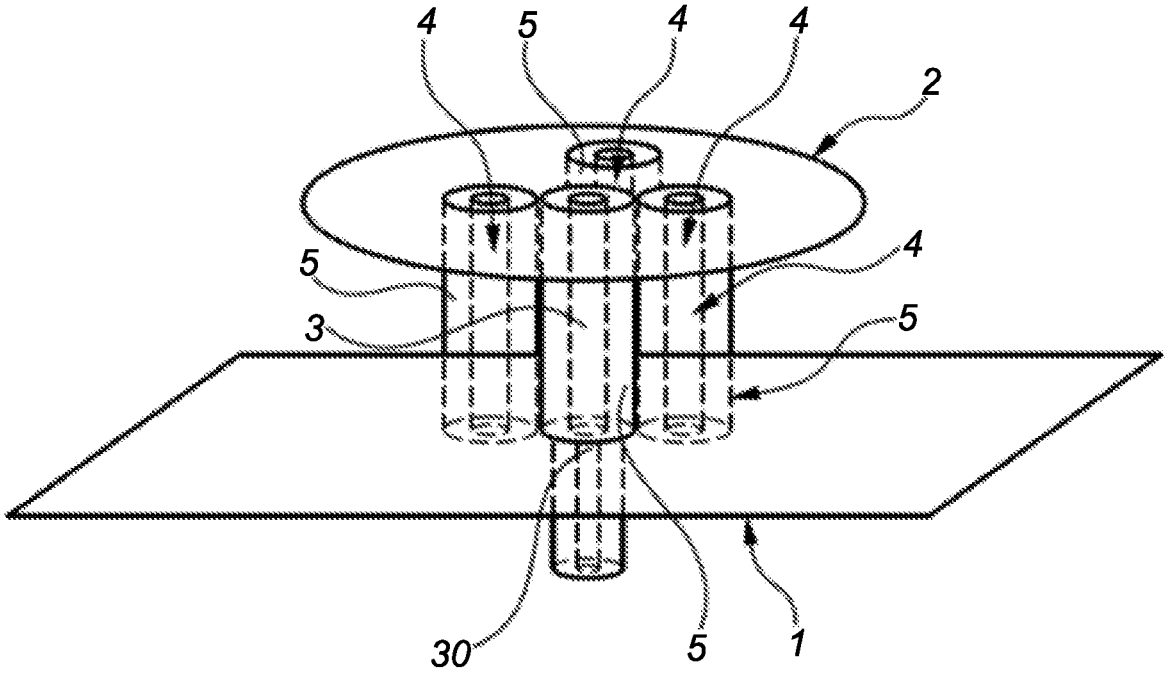
FIG. 5 is a schematic perspective view of an antenna according to the invention, illustrating a second embodiment of the coating (individual coating of the shorting wires and of the probe feed) with the magneto-dielectric material.
Figure 6:
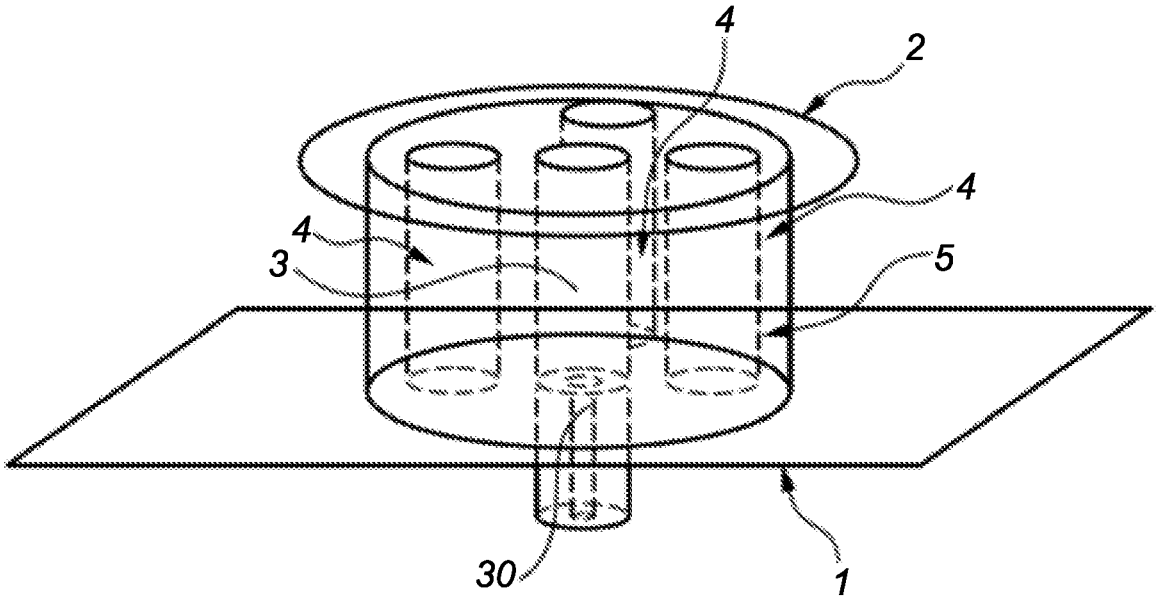
FIG. 6 is a schematic perspective view of an antenna according to the invention, illustrating a third embodiment of the coating (blanket coating of the shorting wires and of the probe feed) with the magneto-dielectric material.

The probe feed 3 is preferably arranged at the center of the ground plane 1, as illustrated in FIGS. 2 to 6. The probe feed 3 is advantageously coated in a magneto-dielectric material 5 having a complex magnetic permeability that varies as a function of a static magnetic field applied to the magneto-dielectric material 5, as illustrated in FIGS. 5 and 6.

The probe feed 3 is intended to be connected to a transmission line allowing the guided propagation of electromagnetic waves (e.g. waves in the radiofrequency range), the transmission line possibly being a coaxial-cable feed or another waveguide.

According to one variant embodiment (not illustrated), the probe feed 3 may take the form of a loop feed intended to be connected to a differential connection that makes it possible not to use a balun between the transmission line and the loop feed.

Shorting Wire(s)

The one or more shorting wires 4 are preferably made of a metal. The one or more shorting wires 4 advantageously extend perpendicular to the ground plane 1, and therefore perpendicular to the capacitive roof 2. When the antenna comprises a set of shorting wires 4, the shorting wires 4 of the set are advantageously parallel to one another. The one or more shorting wires 4 are arranged at a distance from the probe feed 3.

The antenna advantageously comprises a set of shorting wires 4, which are arranged in parallel around the probe feed 3 so that each shorting wire 4 electrically connects the capacitive roof 2 to the ground plane 1, each shorting wire 4 being coated in a magneto-dielectric material 5 having a complex magnetic permeability that varies as a function of the static magnetic field applied to the magneto-dielectric material 5.

When the probe feed 3 is arranged at the center of the ground plane 1, the set of shorting wires advantageously comprises at least one pair of shorting wires 4 that is arranged around the probe feed 3 in such a way as to exhibit central symmetry.

The capacitive roof 2 and the ground plane 1 each have a maximum characteristic dimension such that the antenna is contained in a sphere with an electric radius smaller than or equal to $\lambda/2\pi$, where $\lambda$ is the wavelength of operation of the antenna. More precisely, when the antenna comprises a set of shorting wires 4, the number (denoted N) of shorting wires 4 is chosen so that, for a given amount of magneto-dielectric material 5, the capacitive roof 2 and the probe feed 3 each have a maximum characteristic dimension such that the antenna is contained in a sphere with an electric radius smaller than or equal to $\lambda/2\pi$, where $\lambda$ is the wavelength of operation of the antenna.

If each shorting wire 4 is considered to possess a radius, denoted a, and each shorting wire 4 is considered to be separated by a distance, denoted b, from the probe feed 3, the inventors have demonstrated that the set of shorting wires 4 is equivalent to a single wire possessing a radius (called the equivalent radius $R_{eq}$) that respects:

$$R_{eq}=(ab^{N-1})^{1/N}, N\in[[1;3]]$$

The inventors postulate that this formula works regardless of the number of shorting wires 4 separated by a distance, denoted b, from the probe feed 3, i.e. that the set of shorting wires 4 is equivalent to a single wire possessing an equivalent radius $R_{eq}$ that respects:

$$R_{eq}=(ab^{N-1})^{1/N}, N\in N^*$$

The inventors have observed that, for a given amount of magneto-dielectric material 5, placing a set of N shorting wires 4, each of which is coated with a magneto-dielectric material 5, in parallel allows the resonant frequency of the antenna to be decreased (independently of the static magnetic field applied to the magneto-dielectric material) to frequencies that are 30% lower, relative to a single shorting wire 4 coated with the magneto-dielectric material 5 and possessing an equivalent radius $R_{eq}$ calculated with the preceding formulas. In other words, placing a set of N shorting wires 4, each of which is coated with a magneto-dielectric material 5, in parallel allows the effectiveness with which the antenna is loaded by the magneto-dielectric material 5 to be increased. For an architecture with a single shorting wire 4, it has been estimated that the volume of magneto-dielectric material would need to be 20 times greater to decrease the resonant frequency of the antenna to frequencies that are 30% lower, which would result in a substantial bulk, additional losses (related to the amount of additional material), and an increased antenna weight.

By way of non-limiting example, as illustrated in FIGS. 2 and 3, the set of shorting wires 4 may comprise three pairs of shorting wires 4 that are arranged around the probe feed 3 in such a way as to exhibit central symmetry. Each shorting wire 4 may have a radius (a) of about 2.4 mm. Each pair of shorting wires 4 may be separated by a distance (b) of about 80 mm on either side of the probe feed 3 in such a way as to exhibit central symmetry.

The shorting wires 4 are advantageously separated from the probe feed 3 by a distance chosen to match the input impedance of the antenna to 50 ohms.

As illustrated in FIGS. 4 to 6, it will be noted that the set of shorting wires 4 may comprise an odd number of shorting wires 4. However, this may result in the radiation pattern of the antenna being asymmetrical and cross-polarization appearing.

Magneto-Dielectric Material

The antenna may comprise applying means, which are arranged to apply the static magnetic field to the magneto-dielectric material 5. The applying means are configured to make the strength of the static magnetic field applied to the magneto-dielectric material 5 vary.

Figure 9:
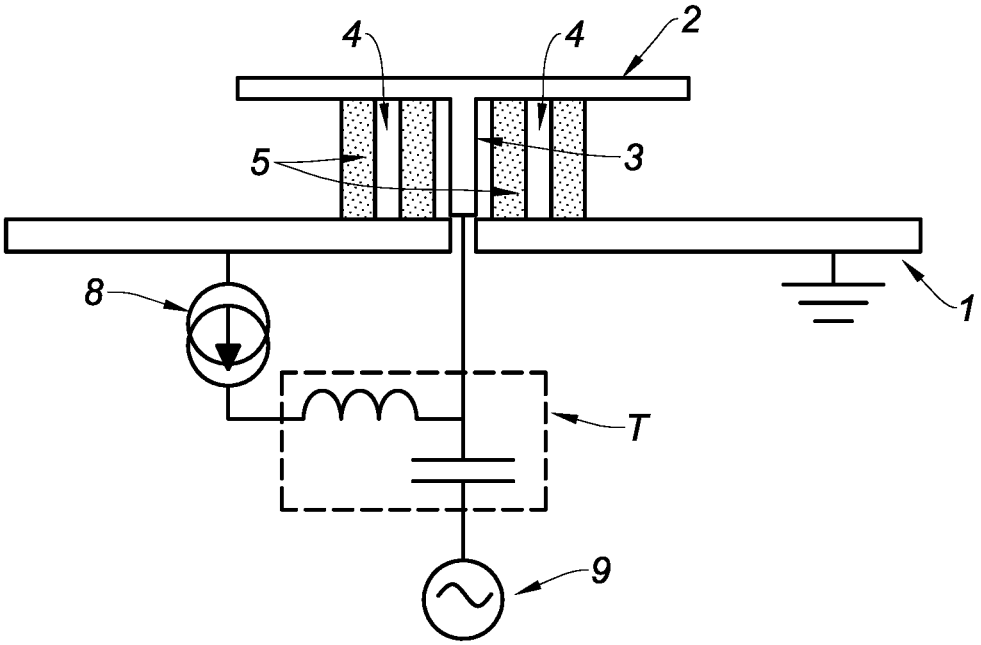
FIG. 9 is a cross-sectional view of an antenna according to the invention, illustrating a DC current source allowing a DC electrical current to be made to flow through the shorting wires with a view to creating a static magnetic field that is applied to the magneto-dielectric material.

The antenna advantageously comprises a DC current source 8 configured to make an electrical current flow through the shorting wire(s) 4, via the probe feed 3 and the capacitive roof 2, so as to apply the static magnetic field to the magneto-dielectric material 5. As illustrated in FIG. 9, the DC current source 8 may be split from an AC current source 9 using a component T, a bias tee T for example. The AC current source 9 is configured to make an AC electrical current flow through the capacitive roof 2, via the probe feed 3, so as to emit the electromagnetic waves.

Figure 10:
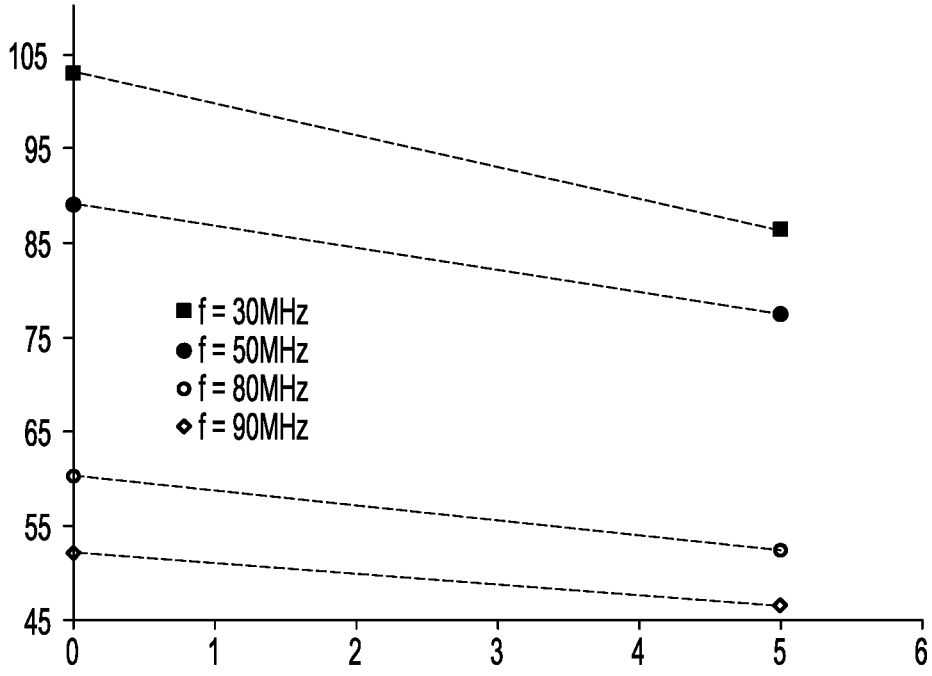
FIG. 10 is a graph showing, on the x-axis, the strength (in oersted) of the static magnetic field applied to the magneto-dielectric material, and, on the y-axis, the real part of the complex magnetic permeability of the magneto-dielectric material, for various frequencies of operation of the antenna (30 MHz, 50 MHz, 80 MHz, and 90 MHz).

The static magnetic field applied to the magneto-dielectric material 5 advantageously has a strength lower than or equal to 400 $A \cdot m^{-1}$. As illustrated in FIG. 10, the complex magnetic permeability of the magneto-dielectric material 5 possesses a real part, and the magneto-dielectric material 5 is advantageously such that the real part decreases, in the frequency range of operation, between 8% and 16% when the strength of the static magnetic field applied to the magneto-dielectric material 5 passes from 0 to 400 $A \cdot m^{-1}$ (as illustrated in FIG. 10). The complex magnetic permeability of the magneto-dielectric material 5 possesses a real part and an imaginary part, and the magneto-dielectric material 5 is advantageously such that the ratio between the imaginary part and the real part is lower than 0.05 in an interval of the frequency range of operation, when the static magnetic field applied to the magneto-dielectric material 5 has a strength lower than or equal to 400 $A \cdot m^{-1}$.

Figure 11:
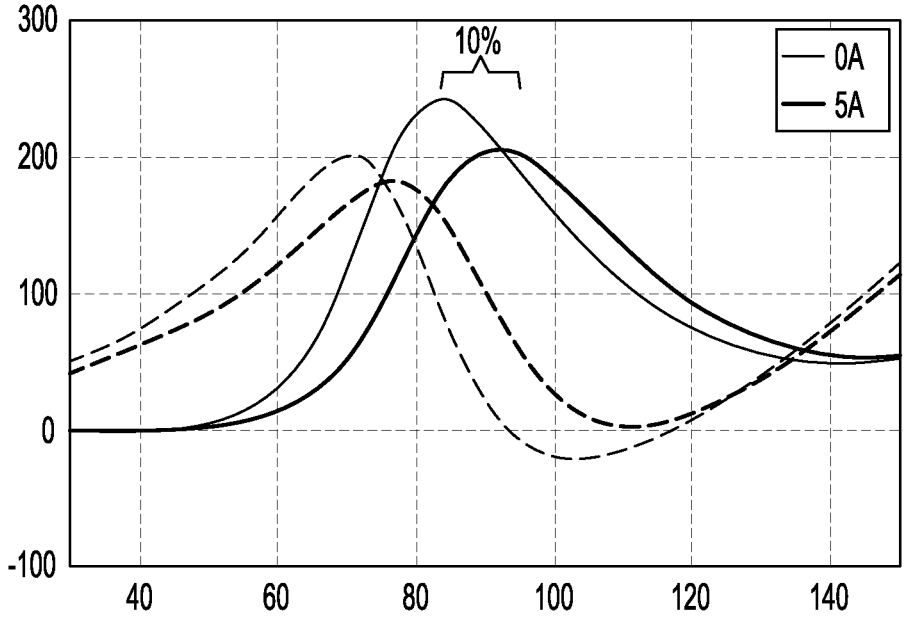
FIG. 11 is a graph showing, on the x-axis, frequency (in MHz) and, on the y-axis, the impedance of the antenna (in ohms) when the DC current source delivers 0 A or 5 A. The continuous lines are plots of the real part of the impedance whereas the dashed lines are plots of the imaginary part of the impedance.

As illustrated in FIG. 11, it is possible to shift the resonant frequency of the antenna to frequencies that are 10% higher by varying the current delivered by the DC current source from 0 A to 5 A.

The magneto-dielectric material 5 advantageously has a complex dielectric permittivity that remains constant as a function of the static magnetic field applied to the magneto-dielectric material 5.

As illustrated in FIG. 6, the antenna may comprise a magneto-dielectric layer extending between the ground plane 1 and the capacitive roof 2 so as to coat the one or more shorting wires 4 and the probe feed 3, the magneto-dielectric layer 5 being made of a magneto-dielectric material 5 having a complex magnetic permeability that varies as a function of a static magnetic field applied to the magneto-dielectric material 5. The capacitive roof 2 and the ground plane 1 delineate a cylindrical volume, and the magneto-dielectric layer 5 may extend into all or part of the cylindrical volume.

As illustrated in FIGS. 4 and 5, the magneto-dielectric material 5 may also take the form of a hollow cylinder inside of which a shorting wire 4 or the probe feed 3 lies.

The magneto-dielectric material 5 possesses domain walls with transition regions between two magnetic domains (so-called Weiss domains). A magnetic domain is a region of the material in which the magnetic moments are oriented in the same direction. The domain walls of the magneto-dielectric material 5 are configured so that the magneto-dielectric material 5 has a complex magnetic permeability that varies as a function of a static magnetic field applied to the magneto-dielectric material 5. To do this, the domain walls of the magneto-dielectric material 5 are advantageously formed so as to obtain Bloch walls, i.e. domain walls such that the transition in the transition region between two magnetic domains occurs gradually, in the plane of the domain wall. In addition, the Bloch walls may move so that the magneto-dielectric material 5 has a complex magnetic permeability that varies as a function of a static magnetic field applied to the magneto-dielectric material 5. Moreover, the magneto-dielectric material 5 is advantageously shaped geometrically so as to be unaffected by a demagnetizing effect, so that the complex magnetic permeability varies substantially when the static magnetic field applied to the magneto-dielectric material 5 has a strength lower than or equal to 400 $A \cdot m^{-1}$.

The magneto-dielectric material 5 is advantageously chosen so that the relationship $\mu_r > \varepsilon_r > 1$ is respected in the frequency range of operation, where:

- $\mu_r$ is the relative permeability of the magneto-dielectric material 5;
- $\varepsilon_r$ is the relative permittivity of the magneto-dielectric material 5.

The magneto-dielectric material 5 is advantageously chosen from $Ni_{1-x}Zn_{1-y}Co_{1-z}Fe_{2-\delta}O_4$, with $0.5<x<0.8$; $0.2<y<0.8$; $0<z<0.2$; $\delta<0.5$.

Process for Manufacturing the Antenna

Figure 7:
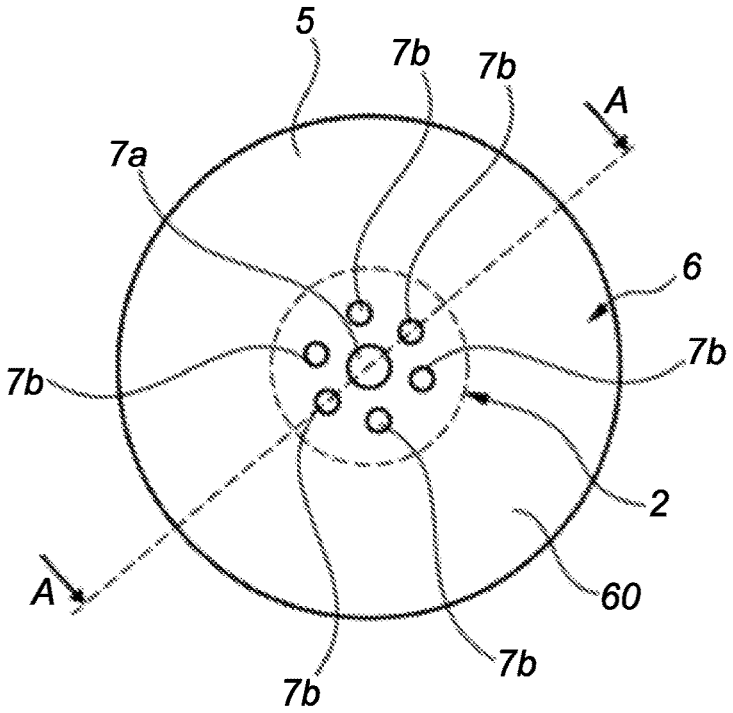
FIG. 7 is a schematic (see-through) view from above of a magneto-dielectric substrate in which vias are formed so as to obtain a monopole wire-plate antenna according to the invention.
Figure 8:
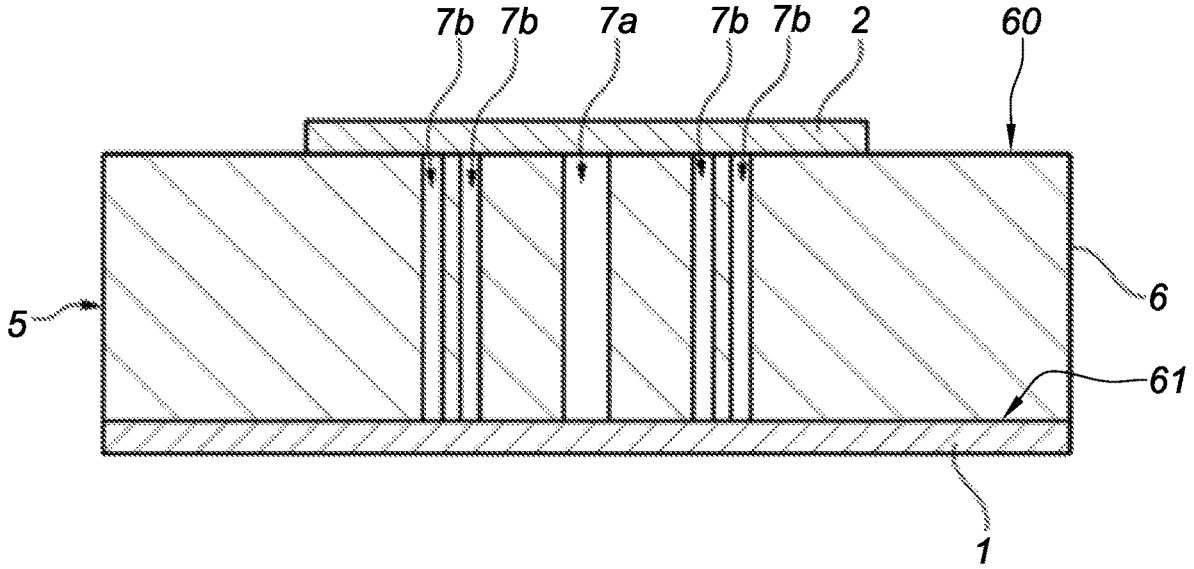
FIG. 8 is a schematic cross-sectional view along the axis A-A through the magneto-dielectric substrate illustrated in FIG. 7.

As illustrated in FIGS. 7 and 8, a process for manufacturing a monopole wire-plate antenna comprises the steps of:

a) providing a substrate 6 made of a magneto-dielectric material 5 and which has first and second opposite planar surfaces 60, 61;

b) forming a first via 7*a* through the substrate 6 so as to obtain a probe feed 3;

c) forming a set of vias 7*b* through the substrate 6, said vias being arranged in parallel around the first via 7*a*, so as to obtain a set of shorting wires 4;

d) forming a capacitive roof 2 on the first surface 60 of the substrate 6;

e) forming a ground plane 1 on the second surface 61 of the substrate 6; step e) being carried out such that the probe feed 3 is electrically insulated from the ground plane 1.

By "via", what is meant is a metallized hole allowing an electrical connection to be made between two interconnect levels.

The vias 7*a*, 7*b* may be metallized by sputtering.

Upon completion of step e), the set of shorting wires 4 and the probe feed 3 are coated with the magneto-dielectric material 5 of the substrate 6.

Process for Manufacturing the Magneto-Dielectric Material

The magneto-dielectric material 5 of the type $Ni_{1-x}Zn_{1-y}Co_{1-z}Fe_{2-\delta}O_4$ with $0.5<x<0.8$; $0.2<y<0.8$; $0<z<0.2$; $\delta<0.5$ may be formed from powders synthesized using a co-precipitation method. Salts of chlorides of iron, of cobalt, of nickel, and of zinc are weighed so as to respect the stoichiometry of the metal elements of the final material. These salts are added to a basic solution of NaOH, raised to boiling point. The pH of the basic solution of NaOH is optimized via successive trials. The mixture is left to react for a time of about 1 hour. Next, the mixture is left to cool to room temperature. The mixture is then rinsed several times in water, until its pH is lower than 8. The mixture is then baked at a temperature of 55° C. for about 48 h, in order to dry it. The obtained dried mixture forms a dry powder, which is then ground, preferably manually. Next, the ground dry powders are compressed and formed by uniaxial pressing, so as to obtain a compact material. The obtained compact material is lastly sintered, preferably at a sintering temperature comprised between 950° C. and 1100° C.

The invention is not limited to the described embodiments. A person skilled in the art is in a position to consider their technically effective combinations and to replace them with equivalents.

The invention claimed is:

1. A monopole wire-plate antenna that is reconfigurable in a frequency range of operation, the antenna comprising:

a ground plane;

a capacitive roof;

a probe feed, which is electrically insulated from the ground plane, and which extends between the ground plane and the capacitive roof so as to electrically feed the capacitive roof;

at least one shorting wire, which is arranged to electrically connect the capacitive roof to the ground plane, and which is coated in a magneto-dielectric material having a complex magnetic permeability, which varies as a function of a static magnetic field applied to the magneto-dielectric material; and a DC current source configured to make an electrical current flow through the at least one shorting wire, via the probe feed and the capacitive roof, so as to apply the static magnetic field to the magneto-dielectric material.

2. The monopole wire-plate antenna as claimed in claim 1, wherein the static magnetic field applied to the magneto-dielectric material is lower than or equal to 400 $A \cdot m^{-1}$.

3. The monopole wire-plate antenna as claimed in claim 1, wherein the complex magnetic permeability possesses a real part, and the magneto-dielectric material is such that the real part decreases, in the frequency range of operation, between 8% and 16% when the static magnetic field applied to the magneto-dielectric material passes from 0 to 400 $A \cdot m^{-1}$.

4. The monopole wire-plate antenna as claimed in claim 1, wherein the complex magnetic permeability possesses a real part and an imaginary part, and the magneto-dielectric material is such that a ratio between the imaginary part and the real part is lower than 0.05 in an interval of the frequency range of operation, when the static magnetic field applied to the magneto-dielectric material is lower than or equal to 400 $A \cdot m^{-1}$.

5. The monopole wire-plate antenna as claimed in claim 1, wherein the magneto-dielectric material has a complex dielectric permittivity that remains constant as a function of the static magnetic field applied to the magneto-dielectric material.

6. The monopole wire-plate antenna as claimed in claim 1, comprising a set of shorting wires, which are arranged in parallel around the probe feed so that each shorting wire electrically connects the capacitive roof to the ground plane, each shorting wire being coated in a magneto-dielectric material having the complex magnetic permeability that varies as a function of the static magnetic field applied to the magneto-dielectric material.

7. The monopole wire-plate antenna as claimed in claim 6, wherein the probe feed is arranged at the center of the ground plane, and the set of shorting wires comprises at least one pair of shorting wires that is arranged around the probe feed in such a way as to exhibit central symmetry.

8. The monopole wire-plate antenna as claimed in claim 1, wherein the probe feed is coated in the magneto-dielectric material having the complex magnetic permeability that varies as a function of the static magnetic field applied to the magneto-dielectric material.

9. The monopole wire-plate antenna as claimed in claim 1, further comprising a magneto-dielectric layer extending between the ground plane and the capacitive roof so as to coat the at least one shorting wire and the probe feed, the magneto-dielectric layer being made of the magneto-dielectric material having the complex magnetic permeability that varies as a function of the static magnetic field applied to the magneto-dielectric material.

10. The monopole wire-plate antenna as claimed in claim 9, wherein the capacitive roof and the ground plane delineate a cylindrical volume, and the magneto-dielectric layer extends into all or part of the cylindrical volume.

11. The monopole wire-plate antenna as claimed in claim 1, wherein the magneto-dielectric material is chosen such that the relationship $\mu_r > \varepsilon_r > 1$ is satisfied in the frequency range of operation, where:

$\mu_r$ is the relative permeability of the magneto-dielectric material; and $\varepsilon_r$ is the relative permittivity of the magneto-dielectric material.

12. The monopole wire-plate antenna as claimed in claim 1, wherein the magneto-dielectric material is chosen from $Ni_{1-x}Zn_{1-y}Co_{1-z}Fe_{2-\delta}O_4$, with $0.5<x<0.8$; $0.2<y<0.8$; $0<z<0.2$; and $\delta<0.5$.

13. The monopole wire-plate antenna as claimed in claim 1, wherein the capacitive roof and the ground plane each have a maximum characteristic dimension such that the antenna is contained in a sphere with an electric radius smaller than or equal to $\lambda/2\pi$, where $\lambda$ is a wavelength of operation of the antenna.

14. The monopole wire-plate antenna as claimed in claim 1, wherein the frequency range of operation is between 30 MHz and 250 MHz.

* * * * *